United States Patent [19]

Shinomiya

[11] 4,006,656

[45] Feb. 8, 1977

[54] SCORING AND CUTTING APPARATUS FOR AN ELONGATED SHEET

[75] Inventor: Tsutomu Shinomiya, Iwatsuki, Japan

[73] Assignee: Kabushiki Kaisha Tomoku, Otaru, Japan

[22] Filed: Oct. 23, 1975

[21] Appl. No.: 625,160

[30] Foreign Application Priority Data

Oct. 25, 1974 Japan ..... 49-122417

[52] U.S. Cl. ..... 83/11; 83/177; 83/425.4; 93/58.2 R

[51] Int. Cl.[2] ..... B26D 3/08; B26F 3/00

[58] Field of Search ..... 83/11, 177, 9, 10, 12, 83/407, 425.1, 425.4; 93/58.2 R

[56] References Cited

UNITED STATES PATENTS

| | | | |
|---|---|---|---|
| 1,998,357 | 4/1935 | Carlson | 83/9 |
| 3,136,649 | 6/1964 | Keahey, Jr. | 83/177 X |
| 3,332,326 | 7/1967 | Haas | 93/58.2 R |
| 3,625,813 | 12/1971 | Eckelman | 83/177 X |

*Primary Examiner*—Willie G. Abercrombie
*Attorney, Agent, or Firm*—Haseltine, Lake & Waters

[57] ABSTRACT

A scoring and cutting apparatus for an elongated sheet member supplied continuously in a longitudinal direction thereof for forming longitudinal score lines and cuts, respectively, at desired intervals of width. The apparatus has a construction comprising a plurality of injection nozzles for cutting the sheet member which are connected to a high pressure liquid supply source and are disposed to form at least two rows extending transversely relative to the moving direction of the sheet member, and a plurality of scoring rolls are also disposed to form at least two rows extending transversely relative to the moving direction of the sheet member, and a plurality of scoring rolls are also disposed to form at least two rows extending parallel to the rows of the projection nozzles, the rows of scoring rolls each being arranged to be movable upwards and downwards between respective inoperative and operative scoring positions. The projection nozzles in each row are slidable for adjusting the transverse spacing therebetween and the scoring rolls are also slidable for adjustment of their transverse spacing.

5 Claims, 7 Drawing Figures

SCORING AND CUTTING APPARATUS FOR AN ELONGATED SHEET

FIELD OF THE INVENTION

The invention relates to a scoring and cutting apparatus in a corrugated board machine or the like wherein an elongated sheet member such as a long corrugated cardboard is continuously supplied.

BACKGROUND

One type of such scoring and cutting arrangement is known in which, in order for the scoring rolls and cutting rolls to be varied, respectively, in widthwise spacing according to various widths of the sheet members to be worked or according to various sizes or shapes of boxes to be produced, at least two sets of scoring rolls and cutting rolls are mounted circumferentially on a frame body so as to be differentiated from one another in their positions and the frame body is arranged to be turnable for adjustment. With this arrangement, when the scoring and cutting are to be varied in width intervals during the time when one set of these scoring and cutting rolls is being operated, another set is previously adjusted in intervals and then the machine is stopped in operation and the foregoing frame body is turned to select the adjusted set while also the sheet is cut off, and thereafter the beginning end of the sheet is newly inserted into the adjusted set of scoring and cutting rolls and the operation of the machine is started again.

Thus, with this arrangement, when it is intended to vary the spacing of the scoring and the cutting lines, it is necessary that the machine be stopped and the sheet newly inserted into the set of the scoring rolls and the cutting rolls previously adjusted. This involves substantial difficulty and greatly lowers the working efficiency. Additionally, for adjusting the cutting rolls, an aligning of the cutting edges of the cutting rolls is very difficult and the adjustment thereof in a short time becomes difficult, so that the same cannot be used when the spacing of the score lines and cutting lines is required to be effected in a short time.

SUMMARY OF THE INVENTION

An object of this invention is to provide a simple construction for scoring and cutting apparatus overcoming the deficiencies of the conventional arrangement. A further object of the invention is to provide scoring and cutting apparatus in which the cutting is effected by means of high pressure liquid projection and scoring and cutting can be varied in transverse spacing continuously without stopping the machine while also a sheet member can be used without any waste by being cut into any desired narrow width.

According to this invention, a plurality of projection nozzles, for cutting the sheet member, are connected to a high pressure liquid supply source and are disposed to form at least two rows extending transversely of the moving direction of the sheet member to be worked, and a plurality of scoring rolls are also disposed to form at least two rows extending parallel to the rows of nozzles, the rows of cutting rolls each being supported to be movable upwards and downwards between respective inoperative and operative positions.

Embodying examples of this invention will next be described with reference to the accompanying drawings.

DETAILED DESCRIPTION

Figure 1:
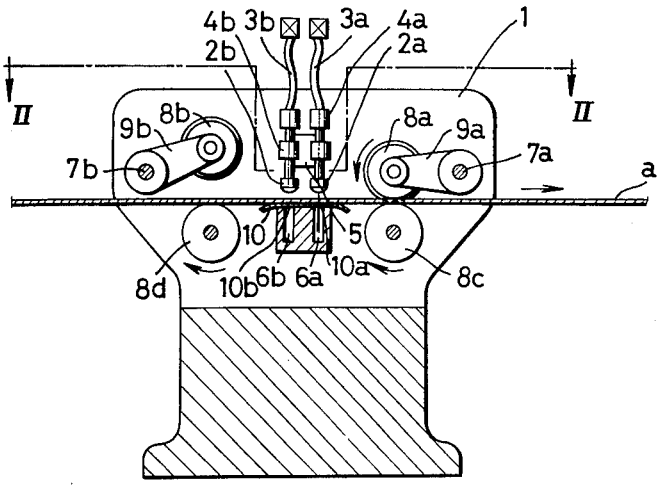
FIG. 1 is a side elevational view, partly in section, of one embodiment according to this invention.

Referring to FIGS. 1 to 5 showing one embodiment of the invention, numeral 1 denotes a machine frame and an elongated sheet member *a* such as a long corrugated cardboard is supplied continuously to pass through the machine in the direction shown by the arrow in FIG. 1. A plurality of projection nozzles 2*a* are connected through respective conduits 3*a* to a high pressure liquid supply source (not illustrated) and a plurality of projection nozzles 2*b* are connected through respective conduits 3*b* to the same supply source. The projection nozzles 2*a* and 2*b* are individually mounted on respective slide members 4*a* and 4*b* which are slidably mounted in respective guide grooves formed in both sides of a supporting rod 5 transversely extending over the sheet member *a*. Thus, the projection nozzles 1*a* and 1*b* constitute respective lateral rows in a front and rear relationship, and the nozzles in each row are adjustable in transverse spacing by sliding in rod 5.

Grooves 6*a*, 6*b* for receiving projected high pressure liquid are provided under the sheet member *a* respectively along the rows of the projection nozzles 2*a* and 2*b*.

On both sides of the foregoing supporting rod 5 there are mounted, in parallel therewith, support shafts 7*a*, 7*b*, and a plurality of lining or scoring rolls 8*a* are slidably and swingably mounted on the shaft 7*a* by means of respective swingable arms 9*a* while a similar plurality of lining or scoring rolls 8*b* are mounted slidably and swingably on the shaft 7*b* by respective swingable arms 9*b*. Thus, the lining rolls 8*a* and 8*b* constitute respective lateral rows in a front and rear relationship above the sheet member *a*, and lining rolls in each row are adjustable in transverse spacing by sliding in the respective shafts while also being swingable upwards and downwards by pivotal movement of their respective swingable arms 9*a* and 9*b* on their respective shafts 7*a* and 7*b*. Additionally, the scoring rolls 8*a* and 8*b* have respective cooperating rolls 8*c* and 8*d* mounted below the sheet member *a* so as to be similarily adjustable in spacing.

Numeral 10 denotes a cover having transverse slots 10*a*, 10*b*, the cover 10 serving to allow the sheet *a* to smoothly slide thereon.

Figure 2:
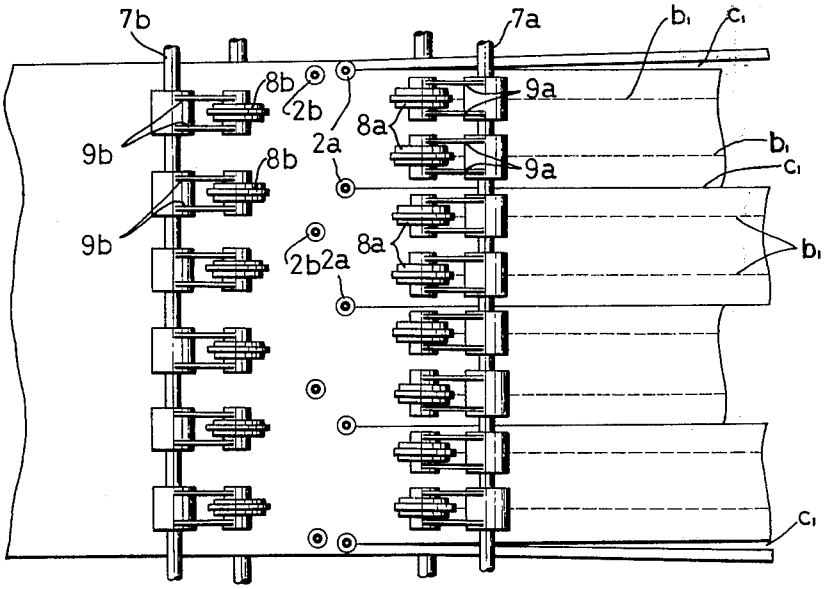
FIG. 2 is a sectional view taken along line II—II in FIG. 1.
Figure 3:
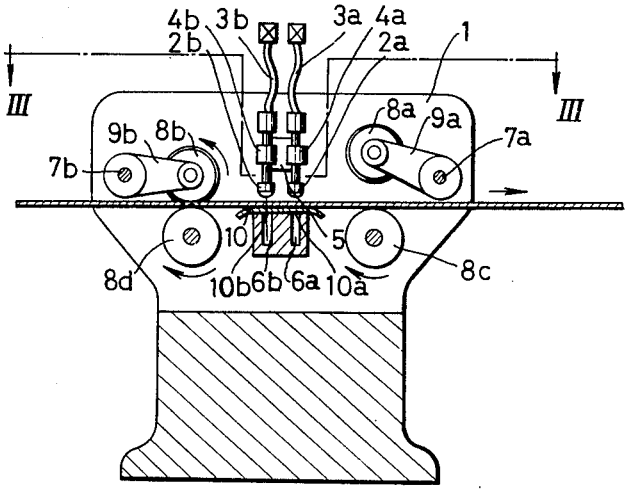
FIG. 3 is a side elevational view of the embodiment with the projection nozzles and lining rolls changed over.
Figure 4:
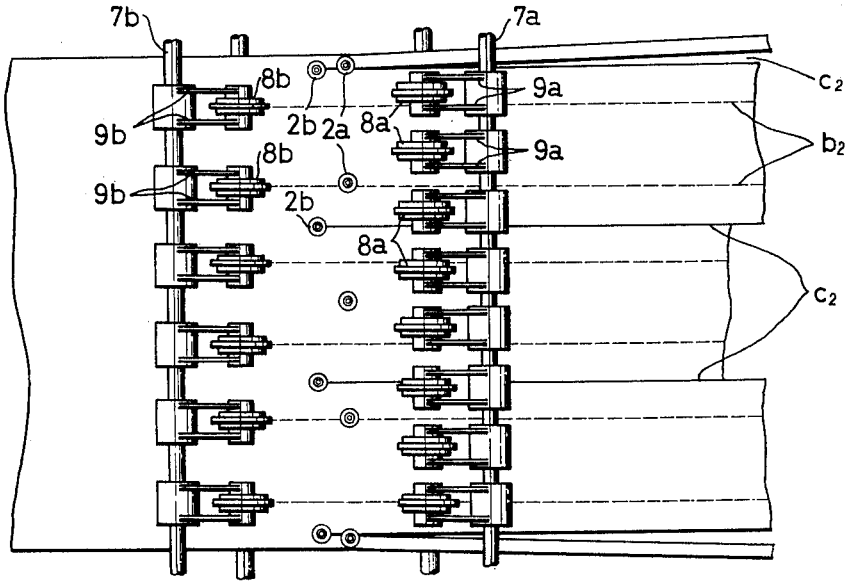
FIG. 4 is a sectional view taken along lines IV—IV in FIG. 3.
Figure 5:
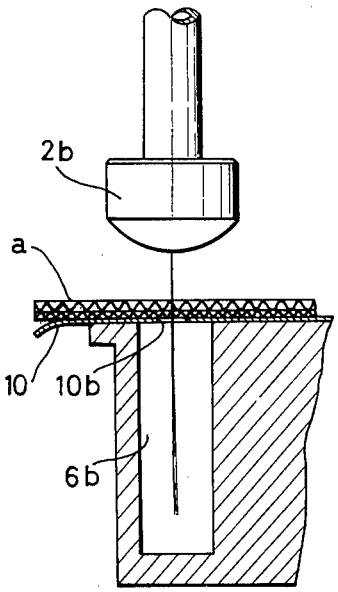
FIG. 5 is an enlarged sectional side view of a portion of a projection nozzle.

If, as shown in FIGS. 1 and 2, the projection nozzles 2*a* on one side are adjusted as regards their transverse spacing by sliding along rod 5 and the scoring rolls 8*a* on the same side are transversely adjusted by sliding and are moved downwards by turning of the shaft 7*a* so that the sheet member *a* which is being supplied continuously may be clamped between the lining rolls 8*a* and the cooperating rolls 8*c* and additionally a high pressure liquid is projected linearly from each of the foregoing projection nozzles 2*a*, then the sheet member *a* will be scored at lines $b_1$ and cut along lines $c_1$ at respective desired transverse intervals. When the scoring and cutting are desired to be varied in widthwise spacing, the lining rolls 8*b* and the cooperating rolls 8*c* and also the projection nozzles 2*b* are previously adjusted transversely, and thereafter the foregoing lining rolls 8*a* are moved upwards by turning of the shaft 7*a* while the projection of the high pressure liquid from the projection nozzles 2a is halted. Then, without stopping the supply of the sheet member *a*, as shown in FIGS. 3 and 4, the lining rolls 8*b* are moved downwards by turning of the shaft 7*b* for clamping the sheet member *a* between the same and the cooperating rolls 8*d* and high pressure liquid is projected linearly from each of the projection nozzles 2*b*, whereby there can be continuously formed score lines $b_2$ and cut lines $c_2$ at desired widthwise intervals.

Figure 6:
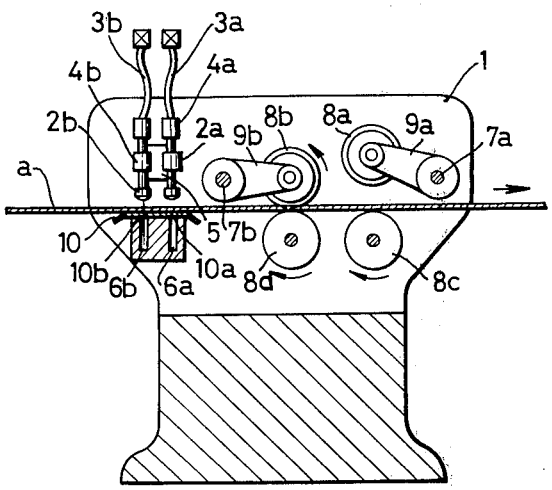
FIGS. 6 and 7 are side elevational views of modified embodiments of the invention.
Figure 7:
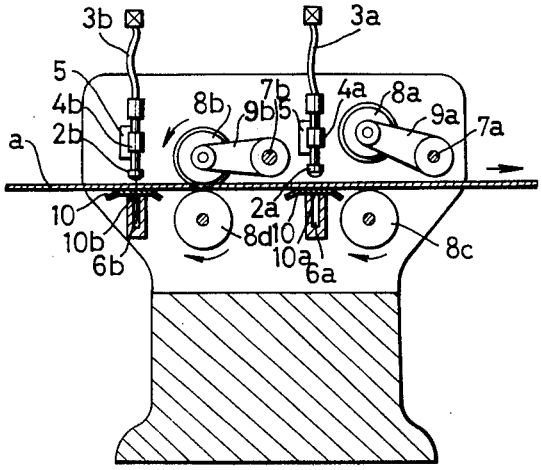

In the foregoing arrangement, the lining rolls 8*a* and the cooperating rolls 8*c* and the lining rolls 8*b* and the cooperating rolls 8*d* are disposed on both sides of the supporting rod 5. However, the arrangement can be modified by mounting these members on one side of rod 5 as shown in FIG. 6 or alternately with the projection nozzles as shown in FIG. 7.

Thus, according to the invention, a plurality of projection nozzles connected to a high pressure liquid supply source are arranged in at least two rows extending transversely across a longitudinally advancing sheet member and additionally a plurality of scoring rolls are also arranged in at least two rows parallel to the rows of nozzles, each row of the scoring rolls being arranged to be movable upwards and downwards, thereby avoiding the difficulty regarding aligning the cutting edges of the cutting rolls as in the conventional arrangement, while the widthwise intervals of cutting can be varied merely by sliding the projection nozzles. Accordingly, any compensation adjustment in width can be effected simply during operation, and the scoring and cutting at desired widthwise intervals can be obtained continuously and at a high efficiency in that the rows of the scoring rolls and the rows of the cutting rolls are adjusted previously to the desired lining width and the desired cutting width and these are interchanged. Additionally, large reaction forces are not produced on the projection nozzles during the cutting operation thereof, so that the holding means for the nozzles can be simplified in construction.

What is claimed is:

1. Apparatus for cutting and scoring an elongated sheet member, which is traveling longitudinally, along longitudinal lines at desired transverse spacing, said apparatus comprising a plurality of injection nozzles adapted for projecting a stream of high pressure liquid into the advancing sheet member to cut the same, means supporting said nozzles in two spaced transverse rows, a plurality of scoring rolls disposed in two spaced transverse rows extending parallel to the rows of projecting nozzles, support means for said scoring rolls to move the same upwards and downwards between respective inoperative and operative scoring positions, the supporting means for the nozzles including a transverse support member, said nozzles being slidably mounted on the support member for adjustment of the transverse spacing between the nozzles, said support means for each row of scoring rolls including a transverse support member, said rolls being slidably mounted on the support member for adjustment of the transverse spacing between the rolls, said transverse support member being a shaft, said support means further comprising pivot arms mounted on said shaft and carrying respective scoring rolls, said pivot arms being slidable on said shaft to adjust the transverse spacing between the rolls, at least one body disposed on the side of the sheet member opposite said nozzles, said body having at least one transverse groove facing the rows of said nozzles and being aligned therewith, and a cover on said body to facilitate travel of the sheet member thereon, said cover being provided with a slot aligned with said groove.

2. Apparatus as claimed in claim 1 wherein the transverse support member has opposite side surfaces, said rows of nozzles being slidably mounted at said opposite side surfaces of the transverse support member.

3. Apparatus as claimed in claim 2 wherein said scoring rolls are disposed on opposite sides of said support member.

4. Apparatus as claimed in claim 2 wherein said scoring rolls are disposed on one side of the support member.

5. Apparatus as claimed in claim 1 wherein said rows of nozzles and scoring rolls alternate in the longitudinal direction of travel of the sheet member.

* * * * *